United States Patent [19]

Yui

[11] Patent Number: 4,627,342

[45] Date of Patent: Dec. 9, 1986

[54] HEATED SLEEVE PRINTING ROLL COUPLE WITH CLUTCH-BRAKE UNIT CONTROL

[75] Inventor: Katsufumi Yui, Saitama, Japan

[73] Assignee: E.D.M. Corporation, Tokyo, Japan

[21] Appl. No.: 759,431

[22] PCT Filed: Sep. 27, 1984

[86] PCT No.: PCT/JP84/00461

§ 371 Date: Jan. 22, 1986

§ 102(e) Date: Jan. 22, 1986

[87] PCT Pub. No.: WO86/01774

PCT Pub. Date: Mar. 27, 1986

[30] Foreign Application Priority Data

Sep. 13, 1984 [JP] Japan ..... 59-139115
Sep. 13, 1984 [JP] Japan ..... 59-139116
Sep. 13, 1984 [JP] Japan ..... 59-139117

[51] Int. Cl.[1] ..... B41F 1/07

[52] U.S. Cl. ..... 101/25; 101/219; 101/235; 101/329; 101/349

[58] Field of Search ..... 101/23–25, 101/5, 8, 92, 213, 219, 233, 234, 235, 348–349, 329, 212, 245

[56] References Cited

U.S. PATENT DOCUMENTS

| | | | |
|---|---|---|---|
| 3,260,193 | 7/1966 | Mann | 101/235 |
| 3,537,393 | 11/1970 | Hegi | 101/235 |
| 3,730,081 | 5/1973 | Colledge | 101/25 |
| 3,830,154 | 8/1974 | Negi et al. | 101/235 |
| 4,023,489 | 5/1977 | Beery | 101/235 |
| 4,220,084 | 9/1980 | Maclean et al. | 101/235 |
| 4,334,471 | 6/1982 | Noyes et al. | 101/235 |
| 4,470,349 | 9/1984 | Godlewski | 101/233 |
| 4,527,472 | 7/1985 | Davison | 101/219 |
| 4,528,907 | 7/1985 | Davison | 101/219 |

FOREIGN PATENT DOCUMENTS

| | | | |
|---|---|---|---|
| 62186 | 5/1981 | Japan | 101/213 |
| 868168 | 5/1961 | United Kingdom | 101/219 |

*Primary Examiner*—E. H. Eickholt
*Attorney, Agent, or Firm*—Kalish & Gilster

[57] ABSTRACT

A printer which comprises a printing roll mounted upon a main shaft for rotation, an ink roll presented in axial parallel relationship to said printing roll and having heat-soluble ink, a clutch brake unit operatively connected to said printing roll and ink roll for controlling rotation thereof consonant with the printing interval of material to be printed responsive to a feeding mechanism, an encoder for translating the rate of speed of said material into a pulse of unit length. A heat sleeve is concentrically disposed upon said main shaft for rotation therewith; there being a heater element provided within said heat sleeve. A printing type holder is removably mounted on the outer periphery of said heat sleeve for receiving ink from said ink roller. A power supply shaft cooperates with said feed mechanism, and a quill shaft is provided for operative connection to said power supply shaft to transmit rotation to said printing roll and ink roll. An electromagnetic clutch is provided for intermittently disconnecting said power supply shaft and said quill shaft.

3 Claims, 7 Drawing Figures

50
CK
PE
B
51
52
Q
CK
R
54
Q
CK
Q
R
55
56
34
33
35
38
45
44
X
53b
53a
53c
53

HEATED SLEEVE PRINTING ROLL COUPLE WITH CLUTCH-BRAKE UNIT CONTROL

BACKGROUND AND SUMMARY OF THE INVENTION

This invention relates in general to printers of the type for automatic printing of letters and numerals for setting forth production dates, weights, prices, and the like on continuously fed wrapping film, as of synthetic resin and the like, and, more particularly, to an improvement in a printer of the hot-roll type adapted for heating the printing roll. A hot-roll printer incorporating a printing roll with printing type heated to a temperature of between 120° C. to 150° C. with the surface of the type being inked through contact with an ink roll for reliable and clear printing upon a suitable printing material, such as continuously fed synthetic resin film, has been set forth an described in Japanese Utility Model No. 45154/1983 having been filed by the present inventor. In a printer of such type it is necessary to embody a structure wherein the printing part can rotate while being heated by heater element since the printing operation is effected by rotation of a printing roll.

In the aforesaid utility model application the inventor has disclosed a hot-roll printer wherein an electric heater is installed within the printing roll which constitutes a printing part. Therein, in order to provide electricity to the heater element it was necessary to present, on the rotating side, a slip-ring to connect with the heater element, and, on the fixed side, a brush to contact with the slip-ring. In addition to providing an electricity feeding mechanism of such type, the same has caused a further problem by necessitating an increase in the axial dimension of the printing part, thus enhancing its size. Furthermore, the electrical contact between the slip ring and the brush is apt to become unreliable during usage which is clearly a serious disadvantage to securing a stable supply of electricity and assuring of maintaining the printing part in reliable condition. Still further, as the heating element in such structure effects its cycle of rotation and stopping with the printing roll, the leads are apt to break because of vibration developed during rotation so that the same become inoperative in a reasonably short period.

A further drawback of this prior art structure is the difficulty in securing to the printing roll a thermo-sensor for maintaining the heating temperature consistent within the range of 120° C. to 150° C. so that it is substantially impossible to assure of accurate temperature.

In the structure set forth in the above identified utility model application the clutch-brake unit and the encoder of the printer are formed separately and necessitate a large space for the mounting thereof with there also being required rotation transmission means between the encoder and the power supply shaft. All of this further conduces to a substantially enlarged printer. The clutch-brake unit and the encoder are thus of a size out of proportion with respect to the relatively small character of the hot-roll printer and thus detract from the design of the device.

In the operation of printers of this type it is requisite to maintain the ink roll warm in order to maintain the fluidity of the absorbed ink. The surface of the printing type set on the printing roll is frequently non-uniform and uneven. In most cases the lack of uniformity of the type surface is due to an error in either molding or securement and thus the amount of ink to be applied to the type varies depending upon the size, thickness and nature of the letter of the type, or upon various outer dimensions of the ink roll. Therefore, it is preferable that a printing device have a means to enable a fine adjustment of the distance between the ink roll and the type.

Furthermore, the prior art structure as set forth in the aforesaid utility model application, although being provided with a mechanism for such a fine adjustment, is one that is of a complicated link structure and prone to breakdown in the portions supporting the ink roll. Accordingly, there is a problem of providing a fine adjustment that can be effected accurately betwen the ink roll and the printing type.

Accordingly, it is the primary object of the present invention to solve the numerous problems above enumerated with respect to the prior art structure.

Another object is to provide a printer which does not require the supply of electricity by means of a slip ring so that the printing part may be of relatively reduced size and more readily maintainable.

Another object of the present invention is to provide a printer wherein the life of the heater may be relatively prolonged and the thermal control for the printing part easily effected.

It is still another object of the present invention to provide a printer wherein a unitary compact mechanism may be provided for inclusion of the clutch brake unit and an encoder which conduces to substantial reduction in the overall size of the printer.

It is a still further object of the present invention to provide a printer wherein a fine adjustment of the distance between the ink roll and the printing roll type can be accurately achieved and with the ink roll being supported in a stable fashion by a simple supporting mechanism.

BRIEF DESCRIPTION OF THRE DRAWINGS

Figure 6:
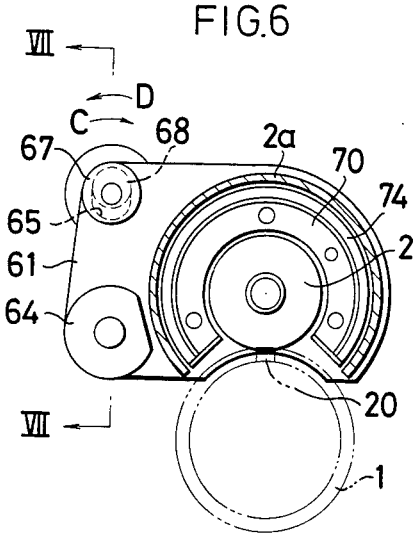
FIG. 6 is a vertical transverse sectional view taken on the line VI—VI of FIG. 5.
Figure 7:
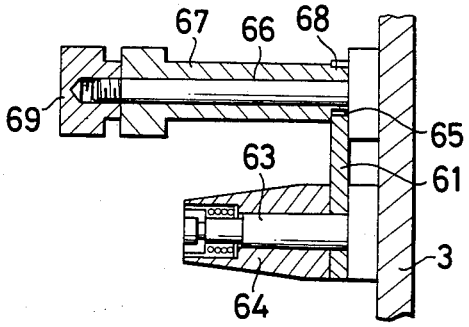

FIG. 7 for a vertical transverse sectional view taken on the line VII—VII of FIG. 6.

DESCRIPTION OF THE PREFERRED EMBODIMENT

Figure 1:
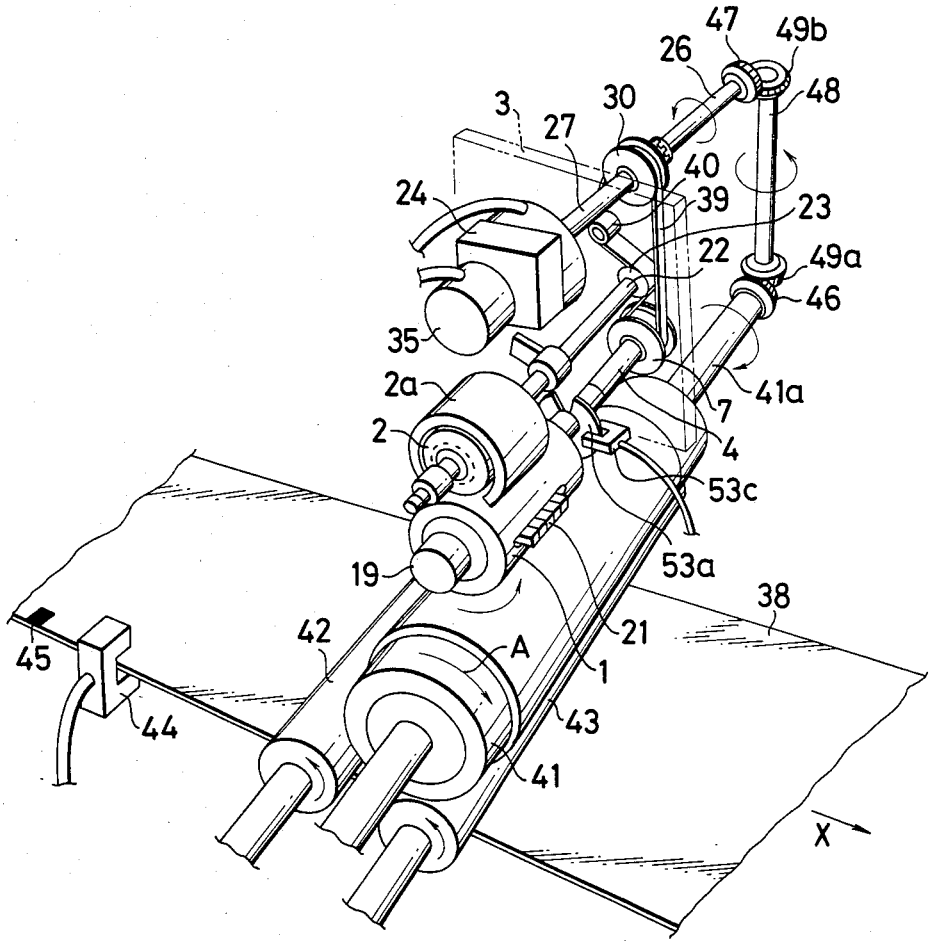
FIG. 1 is a general perspective view of the printer constructed in accordance with and embodying the present invention.
Figure 2:
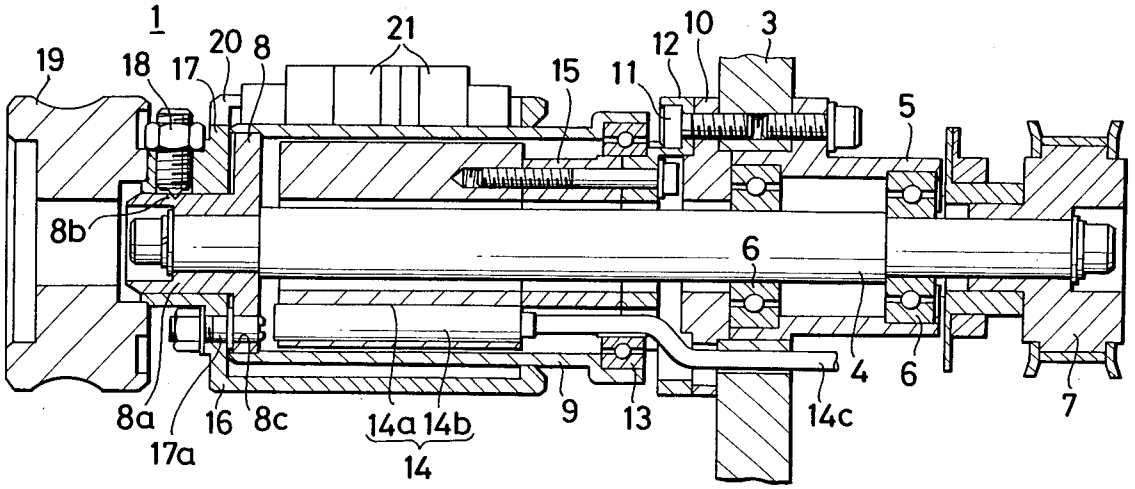
FIG. 2 is an enlarged longitudinal sectional view of the ink roll.
Figure 3:
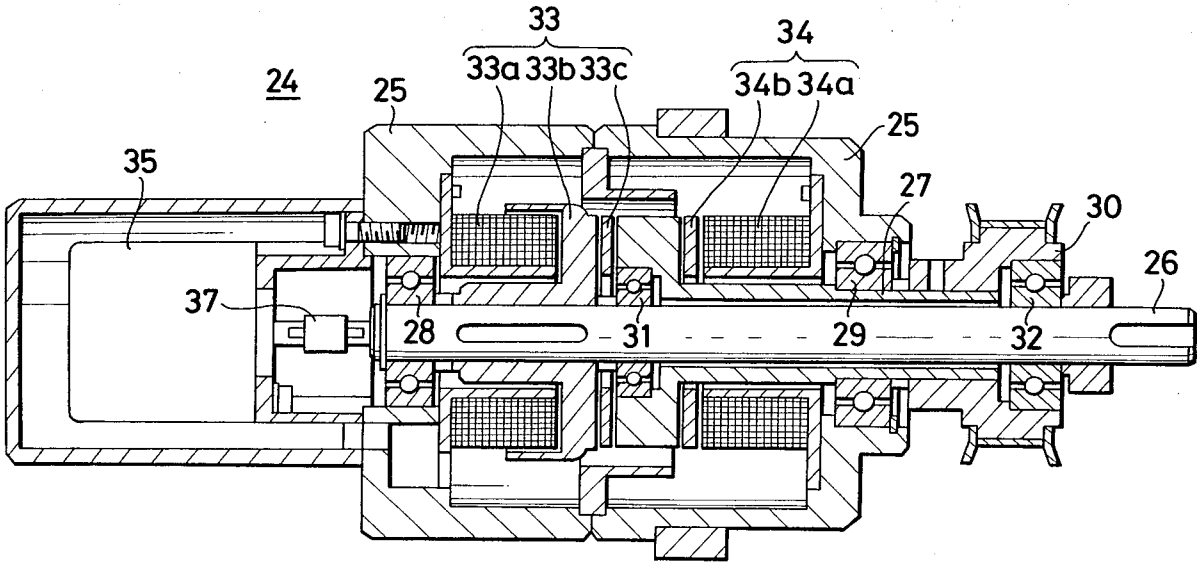
FIG. 3 is an enlarged longitudinal sectional view illustrating the encoder, the clutch-brake unit, and related structure.

Referring now by reference characters to the drawings which illustrate the preferred embodiment of the present invention, FIGS. 1–3, inclusive, illustrate a printer constructed in accordance with the present invention wherein 1 indicates a hot-type printing roll and 2 designates an ink roll disposed above, and in parallel relationship with, printing roll 1. Said rolls 1 and 2 are supported by a vertically presented base plate 3.

As shown in FIG. 2 printing roll 1 is carried upon a main shaft 4 which is journalled in bearings 6 carried in bracket 6' secured in base plate 3, said shaft extending therethrough and being thus in axially perpendicular relationship to the plane of said plate 3. On the outer end of shaft 4 there is carried a timing pulley 7 with a flange 8 being mounted on the other or inner end thereof. To flange 8 is secured one end of heat sleeve 9 which is presented concentrically with main shaft 4, the other end of sleeve 9 being supported by a flange 12 and being rotatable by means of ball bearings 13 carried by said flange 12 which latter is secured to base plate 3 and by means of a bolt 11; there being heat-insulating material interposed between said flange 12 and sleeve 9. Interiorly of heat sleeve 9 and concentric therewith is a heater 14 for warming of printing roll 1. Heater 14 comprises a cylindrical heater box 14*a* with a replaceable cartridge heater 14*b* provided therein. One end of heater 14 is secured to flange 12 on the proximate side of base plate 3 and with there being heat insulating material as at 15 interposed therebetween. Cartridge heater 14*b* is connected to a source of electricity (not shown) by a lead cable 14*c* which extends through suitable openings in base flange 12 and plate 3.

Removably secured on the outer periphery of heat sleeve 9 is a cylindrical printing type holder 16 which at one end thereof, as the inner, is provided with a flange 17 having a center opening 17*a* fittedly receiving a boss a of flange 8 of heat sleeve 9. Engaged on flange 13 is a click-stop mechanism for reception into an annular groove 8*b* formed on boss 8*a* whereby printing type holder 16 is engaged to heat sleeve 9. Flange 8 is provided with an opening 8*c* within which is inserted a positioning pin 17*a* whereby the positioning and securing of printing type holder 16 is effected in a circumferential direction with respect to sleeve 9. Mounted at the outer end of flange 17 is an integrally formed control knob 19 for removal or insertion of printing type holder 16. Provided on the outer peripheral surface or printing type holder 16 is an axially extending elongated opening for removably receiving printing type 21, the surface of which is provided with certain information such as a date, weight, price, etc.

Ink roll 2 is made of formed polyurethane which is soaked with heat-soluble ink, and as seen from FIG. 1, said roll is mounted upon an ink roll shaft 22, which is axially parallel to main shaft 4. Shaft 22 is rotatably supported by base plate 3 and with an end thereof projecting therethrough and extending therefrom and being provided in its extended portion with a pulley 23. 2*a* indicates a cover for ink roll 2 within which is disposed a heater (not shown) by which ink roll 2 is heated within a range of about 70° C. to 90° C.

24 indicates a clutch-brake unit (FIG. 3) which is located above ink roll 2 and adapted for support from base plate 3. Clutch-brake unit 24 comprises a housing 25 fixed to base plate 3, a power-supply shaft 26 provided within housing 25, axially parallel with main shaft 24, and a power-transmitting quill shaft 24 concentric with, and encircling, power supply shaft 27. Bearings for journalling of shaft 26 are provided beyond the inner and outer end portions of quill shaft 27 within housing 25, and with there being a timing pulley provided on the protruding or outer end portion of quill shaft 27 and the corresponding portion of power supply shaft 26, thereby permitting said shafts 26, 27 to rotate independently of each other.

Within housing 25 there is provided an electro-magnetic clutch 33 for intermittent disconnection of power supply shaft 26 from quill shaft 27 and also an electro-magnetic brake 34 is provided concentrically of, and surrounding, a power supply shaft for effecting stoppage of rotation of quill shaft 27. Electro-magnetic clutch 33 comprises a coil 33*a*, an armature 33*b* and a clutch disk 33*c*. Electro-magnetic brake 34 comprises a coil 34*a* and a brake disk 34*b* (see FIG. 3) and an encoder 35 is connected through a coupling 37 to the inner end of power supply-shaft 26; said encoder 35 being adapted to translate the feed of printing material 38 into an electric pulse.

A timing belt 39 is trained about pulley 7 and 30 with one course being also trained over pulley 23 carried on the distal end of ink roll shaft 22. A tension pulley 40 is provided for said belt 39.

Referring now to FIG. 1, a printing type receiving roll 41 is positioned beneath printing roll 1 in axial parallel relationship thereto; and with printing material 38, such as of synthetic resin form, being directed by guide rolls 42, 43 for disposition over said receiving roll 41. Whereby said material 38 is caused to move in a direction indicated by arrow x when the same is fed by feeding means (not shown). A mark sensor 44 is provided for detecting the regimark 45 provided on printing material 38. A bevel gear 46 is mounted on a projecting extension of shaft 41 being indicated at 41*a* (FIG. 1). 47 indicates a bevel gear mounted on the outer end extremity of power supply shaft 26 and with such gears 46, 47 being respectively engaged to cooperating bevel gears 49*a*, 49*b*, respectively, which are respectively mounted on the lower and upper end portions of a vertically presented transmission shaft 48 whereby rotation of shaft 41 will be transmitted to power supply shaft 26.

Figure 4:
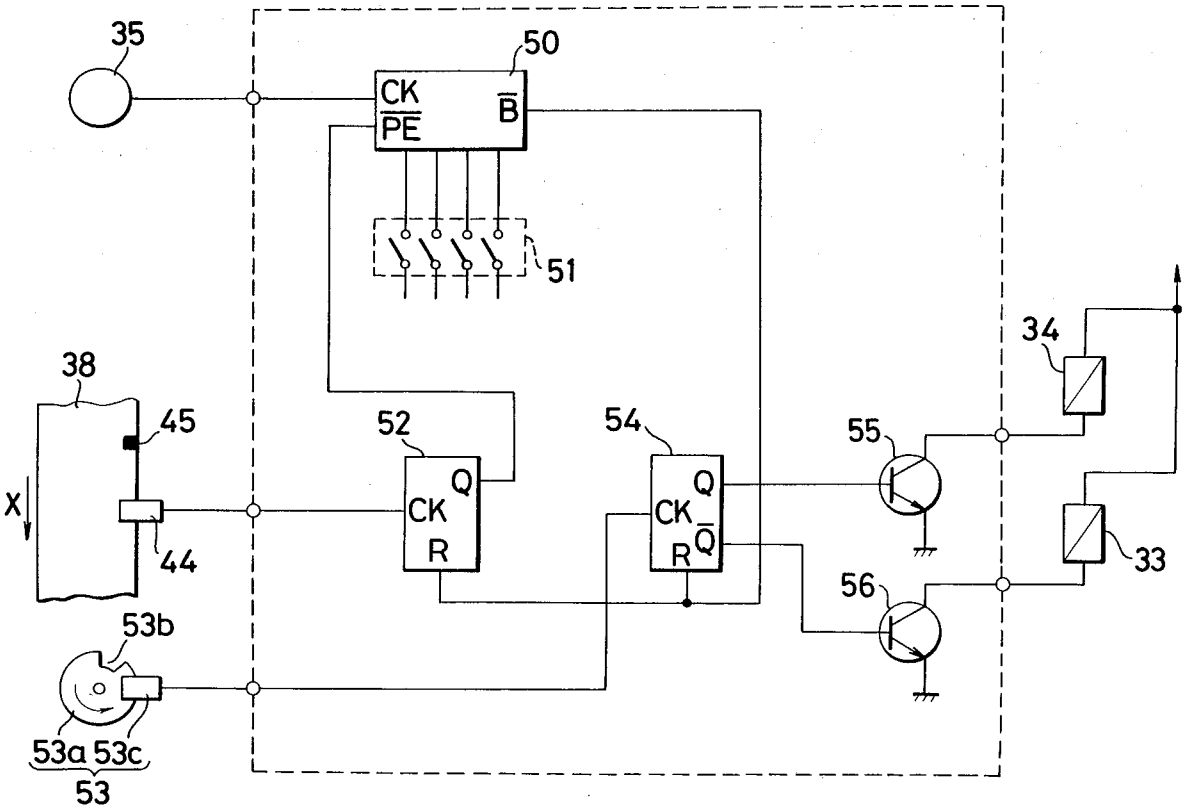
FIG. 4 is a block diagram of the printing control circuit.

FIG. 4 illustrates the printing control circuit for the present invention, and which essentially comprises a counter 50 to detect and count the pulse signal from encoder 35, a count setting device 51 for determining the printing position of the printing material 38 by reason of the presetting the display of counter 50, a flip-flop 52 which is set for operation responsive to the output signal from mark sensor 44 and the output of which causes the counter 50 to work, a flip-flop 54 which is set responsive to the output signal from stoppage detection unit 53 for detecting whether printing roll 1 has discontinued rotation at a predetermined position. To the set output end Q of flip-flop 54 there is connected the base of transistor 55 for controlling electro-magnetic brake 34; while to the reset output end $\overline{Q}$ of flip-flop 54 there is connected the base of transistor 56 which controls electro-magnetic clutch 33. Flip-flops 52, 54 are reset in accordance with the count-up signal b from counter 50. Furthermore, unit 53 of printing roll 1 comprises a disk 53*a* carried on main shaft 4, a photo electric switch 53*c* for detecting the cut-away portion 53*b* on disk 53*a*. The operation of the above-described structure will now be explained. When the electric current is turned on flip-flops 52, 54 of the control circuit shown in FIG. 4 are reset. Then the set output end Q of flip-flop 54 goes low, "L", which deenergizes transistor 55 and places electro-magnetic brake 34 in a demagnetized condition so that quill shaft 27 is in rotatable condition. As Q output of flip-flop 54 goes high, "H", transistor 56 is turned on whereby electro-magnetic clutch 33 is energizd, and power-supply shaft 26 is connected with quill shaft 27 for joint rotation. At this stage, when printing material 38 is caused to travel forwardly in the direction indicated by X in FIG. 1 and with print type receiving roller 41 being caused to rotate in the direction indicated by the letter "A" in FIG. 1, motion transmission is effected through the following train: bevel gear 46→bevel gear 49*a* →shaft 48→bevel gear 49*b*→bevel gear 47→power supply shaft 26→electro-magnetic clutch 33→ quill shaft 27→pulley 30→belt 39→pulley 30→belt 39→ pulley 7→ main shaft 4, whereby printing roll 1, together with disk 53*a*, are caused to rotate.

By virtue of the rotation of power supply shaft 26, encoder 35 is caused to rotate whereby a pulse signal is sent responsive to each predetermined unit length of travel of printing material 38, such as, for example, ½ mm. Heater 14 of printing roll 1 is supplied with electricity so that heat sleeve 9 and printing type 21 are heated to a predetermined temperature as within the range of approximately 120° C. to 150° C.; and ink roll 2 is also caused to rotate by reason of belt 39.

When disk 53*a* rotates to cause cutaway portion 53*b* to be in confrontation with photo-electric switch 53*c* an output signal is produced by said switch which causes flip-flop 54 to set-operate. Then the Q output of flip-flop 54 goes high, "H", and the Q output goes low to "L", respectively, thereby turning on transister 55 and de-energizing transistor 56 resulting in the demagnetization of clutch 33 with brake 34 being energized. Thereby quill shaft 27 is disengaged from power-supply shaft 26 and at the same time braked to a stop position whereby printing roll 1 is caused to stop at a predetermined position. Thus the initial determination of the stopped position of printing roll 1 is effected.

When regimark 45 is detected by sensor 44 as printing material 38 travels in accordance with the rotation of roll 41, the output signal omitted from sensor 44 is transmitted to flip-flop 52 as printing instructions, so that flip-flop 52 is caused to set-operate whereby the Q output thereof goes high "H" and counter 50 commences to operate. Counter 50 thus counts the pulse signals emitted from encoder 35 in accordance with the movement of the material 38 and thus measures the feed amount of the same from the regimark 45. Should the counted value agree with that which has already been present by the value setting device 51, a signal B is emitted from counter 50 and the flip-flops 52, 54 are caused to reset.

When flip-flop 54 is reset, the Q output thereof goes low, "L", and brake 34 is de-energized. Simultaneously since the $\overline{Q}$ output goes high "H", clutch 33 is energized causing shaft 26 and quill shaft 27 to interengage. Therefore, rotation of quill shaft 27 is transmitted to printing roll 1 and ink roll 2 by means of pulley 30, belt 39, and pulleys 7 and 23, respectively. By reason of the rotation of printing roll 1 and ink roll 2, ink is caused to adhere to printing type 21. Accordingly, printing type 21 through the inked surface thereof contacts printing material 38 as the same is led over printing roll 41 to effect the printing step.

Printing roll 1 continues to rotate after completion of the printing and when the cut away portion 53*b* of disk 50*a* confronts photo-electric switch 53, a stop signal is emitted from switch 53*c* and the flip-flip 54 is caused to set-operate whereby the Q output of the same goes high "H", and the $\overline{Q}$ output of the same goes low, "L", again, with clutch 33 being de-energized and brake 34 being simultaneously energized to brake quill shaft 27 instantly so that printing roll 1 is caused to stop at a predetermined location. By repeating the same operation, letters are printed on material 38 at predetermined positions thereon, that is, as measured from the point that the regimark is sensed. It should be noted that while main shaft 4 is rotating, only heat sleeve 9, which is connected to said shaft through flange 8, the printing type holder 16, together with the printing type 21 rotate; heater 14 being stationery.

The above described embodiment comprehends the printing type 21 being disposed on one portion of the peripheral surface of the printing type holder 16 and a printing operation is effected once per each rotation of printing roll 1. However, it should be observed that more than two printing types 21 can be provided on the periphery of printing roll 1, in which case a corresponding number of cut-away portions 53*b* would be provided on disk 53*a* to assure determination of stoppage at junctures corrolating to the number of printing type sets.

As may be observed from the foregoing, and according to the present embodiment, heat sleeve 9 is disposed concentrically of main shaft 4 with heater 14 for warming the printing roll 1 being mounted inside sleeve 9 and attached fixedly to base plate 3 whereby it is possible to heat and rotate the printing roll without causing rotation of heat sleeve 9. This means that a conventionally used power-supply means for a heater such as a slip-ring is no longer needed and that the absence of such means is advantageous to make the axial length of the printing roll shorter and to improve the maintenance of the device. Further, the life of the heater can be prolonged because the heating means are structurally independent of the rotating printing roll, and therefore the vibration resulting from the rotation of the latter is not carried over to the heater; additionally because heater 14 is fixed, it is easier to mount the sensor for temperature control, and therefore renders an accurate control of the temperature possible.

Figure 5:
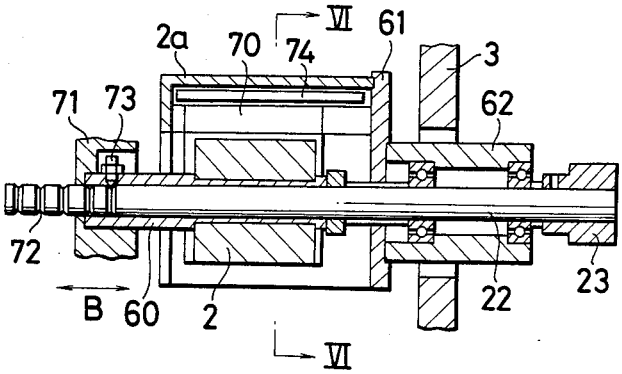
FIG. 5 is an enlarged vertical transverse sectional view of an ink roll constructed in accordance with and embodying the present invention together with the immediately associated structure.

Furthermore, the embodiment of the present invention comprises a structure wherein the power supply shaft which interengages with the feeding mechanism for the printing material 38 and quill shaft 27 for transmission of rotation to ink roll 2 are concentrically disposed so that the two rolls may rotate relatively; with electro-magnetic clutch 33 intermittently effecting disconnection of the power shaft from the quill shaft 27; and with the electro-magnetic brake 34 for arresting rotation of quill shaft 27 being mounted concentrically to power shaft 26. It will be seen that encoder 35 is directly connected with the power supply end. Such structure conduces to the reduction of the space necessary for engaging the clutch brake unit mechanism including the encoder or to make it compact in size, as well as further to omit the need for means to transmit rotation from the power-supply shaft 26 to encoder 35. Moreover, according to the present invention, the attachment of the above-described unit to a small machine such as a hot-roll printer may be easily effected and with the presentation of a device which is of excellent design and balance. Another embodiment of the present invention is illustrated in FIGS. 5–7, inclusive; it being recognized that the essential elements of such embodiment are substantially the same as those shown in FIGS. 1–4, inclusive, so that the same parts are indicated by the same reference numerals. Explanation as to such common parts is omitted to the extent possible.

As shown in FIGS. 5–7, inclusive, ink roll 2 is slidably mounted on ink roll shaft 22 but with a sleeve 60 being disposed therebetween; one end portion of ink roll shaft 22 is journalled by bearings 62 secured to an arm 61. The base part of said arm is pivotally supported by the pivot pin 63, which latter protrudingly extends from base plate 3 so that pivot pin 61 may rotate in an upward or downward direction (such being determined by the direction in which the pin 63 comes into contact with, or disengages from, printing roll 1) within boss 64. An elongated slit-like opening 65 is formed on the rotating portion of arm 61; a clump pin 66 being secured through the slit-like opening 65 to base plate 3 in perpendicular relationship thereto. Rotatably attached to clump pin 66 at its base plate remote end is an adjustment knob 67, the front portion of which has an integrally formed bias member 68 for fine adjustment which member fits into opening 65. Additionally, the front portion of clump pin 66 is anchored at an adjustable position. Arm 61 is secured to a cover **2*a* for ink roll 2 (FIG. 1) within which heater 70 is mounted to maintain the ink soft and in a state of fluidity. Reference numeral 71 indicated an operational handle secured to the outer end of sleeve 60. Said handle 71 is provided with a click stop mechanism 73 which engages within a groove 72 formed on the projecting end of ink roll shaft 22. By turning handle 71 in the direction indicated by an arrow B, as shown in FIG. 5, ink roll 2 can be caused to slide in an axial direction with respect to shaft 22 to alter contact position between ink roll 2 and printing type 21 with the result that the soaked ink can be used without loss. A heat insulating sheet is indicated at 74**.

The following will explain the operation of the embodiment set forth. Such explanation is directed to the control mechanism of ink roll 2 which constitutes a characteristic component of this embodiment, but the printing operation thereof is omitted as the same does not depart from that of the embodiment first above discussed.

In case it is necessary to effect a fine adjustment of the distance between ink roll 2 and printing type 21, the adjustment knob 67 is turned in the direction indicated by an arrow in FIG. 6 after suitable loosening of clump screw 69, whereby bias member 68 turns in the same direction as knob 67, and arm 61 is caused to move slightly downwardly fulcruming pivot pin 63 whereby ink roll 2 is moved slightly in the direction where it is brought into relatively strong contact with printing type 21.

On the other hand, by turning adjustment knob 67 in the opposite direction as indicated by the letter (D) in FIG. 6, ink roll 2 moves slightly in the direction where it lightly contacts printing type 21.

As seen from the foregoing, when the supporting arm of ink roll 2 is pivotally mounted on the base plate 3 in such manner that it can turn upward or downward and the bias member 68 on the adjustment knob 67 is fitted into the elongated slit like opening 65 of arm 61, a fine adjustment as to the distance between ink roll 2 and printing type 21 can be effectively and correctly accomplished by turning adjustment knob 67 and permitting the bias part 68 to move arm member 61 slightly upwardly or downwardly. Such operation is most advantageous in controlling accurately the amount of ink to be applied onto the type surface from ink roll 2, depending on the size, thickness, or kind of letter type, the kind of printing material or the outer dimension of ink roll 2. Such signifies that acording to the present invention the number of printing lines per roll of the ink roll 2 increases permitting clear and beautiful printing to be done.

What is claimed is:

1. A printer comprising a printing roll mounted on a main shaft, means for effecting rotation of said printing roll main shaft, an ink roll presented in axial parallel relationship to said printing roll and provided with heat-soluble ink, a clutch-brake unit operatively connected to said printing roll and said ink roll for controlling rotation thereof consonant with the printing interval of material to be printed, an encoder for translating the rate of feed of said material to be printed into a pulse of unit length, said printing roll rotatable cooperatively with said clutch-brake unit, a heat sleeve concentrically disposed upon said main shaft for rotation therewith, a heater element provided within said heat sleeve for heating thereof and being fixedly mounted whereby said sleeve will rotate relatively thereto, a printing type holder removably mounted on the outer periphery of said heat sleeve and printing type carried on said holder for receiving ink from said ink roller for application upon the material to be printed.

2. A printer comprising a printing roll mounted on a main shaft, means for effecting rotation of said printing roll main shaft, an ink roll presented in axial parallel relationship to said printing roll and provided with heat-soluble ink, a clutch-brake unit operatively connected to said printing roll and said ink roll for controlling rotation thereof consonant with the printing interval of material to be printed, an encoder for translating the rate of feed of said material to be printed into a pulse of unit length, a rigidly mounted housing for enclosing said clutch-brake unit, a feed mechanism for material to be printed, a power-supply shaft concentrically journalled in said housing for rotation relatively therewith and for cooperation with said feed mechanism, a quill shaft adapted for operative connection to said power supply shaft for transmission of rotation to said printing roll and ink roll, an electromagnetic clutch being provided interiorly of said housing for intermittently disconnecting said power-supply shaft from said quill shaft, and an electromagnetic brake to stop said quill shaft quickly, and with said power-supply shaft being directly connected with said encoder.

3. A printer comprising a printing roll mounted on a main shaft, means for effecting rotation of said printing roll main shaft, an ink roll presented in axial parallel relationship to said printing roll and provided with heat-soluble ink, a clutch-brake unit operatively connected to said printing roll and said ink roll for controlling rotation thereof consonant with the printing interval of material to be printed, an encoder for translating the rate of feed of said material to be printed into a pulse of unit length, fixed support means, an arm member pivotally supported upon said fixed support means for movement upwardly and downwardly, said ink roll being rotatably engaged to said arm member, an adjustment knob for fine adjustment of the relative distance between said ink roll and said printing roll, and a biasing element provided on said adjust knob, said arm member having an elongated slit-like opening, and said biasing part being fittedly received within said opening.

* * * * *